US005605645A

United States Patent [19]

Brandstädter-Springer et al.

[11] Patent Number: 5,605,645

[45] Date of Patent: Feb. 25, 1997

[54] FURNACE HEATER SURROUNDED BY A CERAMIC TUBE AND FASTENED WITH A CERAMIC FLANGE

[75] Inventors: Anke Brandstädter-Springer; Ludwig Weiler, both of Heidelberg; Hans Ammon, Wettingen; Fritz Hegewaldt, München, all of Germany

[73] Assignee: ABB Gadelius KK, Tokyo, Japan

[21] Appl. No.: 429,305

[22] Filed: Apr. 26, 1995

Related U.S. Application Data

[63] Continuation of PCT/EP94/02463, Jul. 26, 1994.

[30] Foreign Application Priority Data

Aug. 26, 1992 [DE] Germany ..... 43 28 718.2

[51] Int. Cl.[6] ..... H05B 3/06; H05B 3/62

[52] U.S. Cl. ..... 219/542; 219/523; 219/536; 373/119; 373/127; 373/128

[58] Field of Search ..... 219/523, 536, 219/542, 402, 403, 390, 395; 373/111, 119, 127–128, 130; 392/455

[56] References Cited

U.S. PATENT DOCUMENTS

| | | | |
|---|---|---|---|
| 1,459,307 | 6/1923 | Laise et al. | 219/523 |
| 1,517,301 | 12/1924 | McMichael et al. | 219/536 |
| 1,618,861 | 2/1927 | Landsberger | 219/536 |
| 1,662,555 | 3/1928 | Wojciechowski | 219/536 |
| 1,797,712 | 3/1931 | Brodnax et al. | 219/536 |
| 4,205,233 | 7/1980 | Kastilahn | 219/536 |
| 4,927,475 | 5/1990 | Steinleitner et al. | 156/89 |

FOREIGN PATENT DOCUMENTS

| | | |
|---|---|---|
| 1392081 | 8/1965 | France . |
| 2559886 | 2/1984 | France . |
| 717668 | 2/1942 | Germany . |
| 4014246 | 11/1991 | Germany . |
| 909031 | 10/1962 | United Kingdom . |

*Primary Examiner*—Teresa J. Walberg
*Assistant Examiner*—Raphael Valencia
*Attorney, Agent, or Firm*—Herbert L. Lerner; Laurence A. Greenberg

[57] ABSTRACT

A heating element for a Deglor furnace includes a heating bar being surrounded by a protective tube. The protective tube is provided with a flange for mounting. The flange is formed by a separate ceramic ring or a metal clip and is permanently connected mechanically or chemically to an outer surface of the protective tube.

3 Claims, 2 Drawing Sheets

FURNACE HEATER SURROUNDED BY A CERAMIC TUBE AND FASTENED WITH A CERAMIC FLANGE

CROSS-REFERENCE TO RELATED APPLICATION

This application is a continuation of International application Ser. No. PCT/EP94/02463, filed Jul. 26, 1994.

BACKGROUND OF THE INVENTION

FIELD OF THE INVENTION

The invention relates to a heating element for a Deglor furnace, including a heating bar being surrounded by a ceramic protective tube having a closed end and having an open end with a flange.

Deglor furnaces are used for the vitrification of ash from refuse incineration plants. Impurities contained in the ash are evaporated and separated off. The vitrified constituents can be used as building materials or can be dumped. Deglor furnaces work at temperatures of between 1300° C. and 1500° C. For that purpose, each Deglor furnace is provided with heating elements in its ceiling region. The heating elements are surrounded relative to the outside by a protective tube made of ceramic. That tube is closed at a first end and open at a second end thereof. The protective tubes which were used heretofore have an outwardly-directed flange at their open end which is produced together with the protective tube from one piece. Such flanges are used to mount the protective tubes on the ceiling bricks of the Deglor furnace. Due to temperature fluctuations and corrosion to which the protective tubes are exposed, a destruction of the ceramic tubes can occur. A complete exchange of the heating element is therefore necessary, involving a high outlay.

SUMMARY OF THE INVENTION

It is accordingly an object of the invention to provide a heating element, which overcomes the hereinafore-mentioned disadvantages of the heretofore-known devices of this general type.

With the foregoing and other objects in view there is provided, in accordance with the invention, a heating element for a Deglor furnace, comprising a heating bar; a ceramic protective tube surrounding the heating bar and having an outer surface, a closed end and an open end; and a flange being chemically or mechanically fastened to the outer surface of the protective tube at the open end.

Such a ceramic protective tube can be produced more cost-effectively than protective tubes of the type described in the introduction.

In accordance with another feature of the invention, the flange is formed by a ceramic ring of a specific width or by a metal clip.

In accordance with a further feature of the invention, the flange which is produced from ceramic is permanently fastened to the outer surface of the protective tube by means of a ceramic adhesive or cement.

In accordance with an added feature of the invention, where long protective tubes are concerned, a metal clip is used as a flange instead of a ceramic ring.

In accordance with an additional feature of the invention, a ceramic fleece is disposed as an intermediate layer between the metal clip and the protective tube. The clip is fastened to the outer surface of the protective tube by means of one or more screws.

In accordance with a concomitant feature of the invention, the heating bar disposed within the protective tube is bent in a U-shaped manner. Its ends are guided outwards through a cover to electric connections. The cover is made from ceramic or metal and serves as a mounting for the U-shaped heating bar. The cover closes the interior of the protective tube and is placed onto the top edge of the protective tube or onto the flange.

Other features which are considered as characteristic for the invention are set forth in the appended claims.

Although the invention is illustrated and described herein as embodied in a heating element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
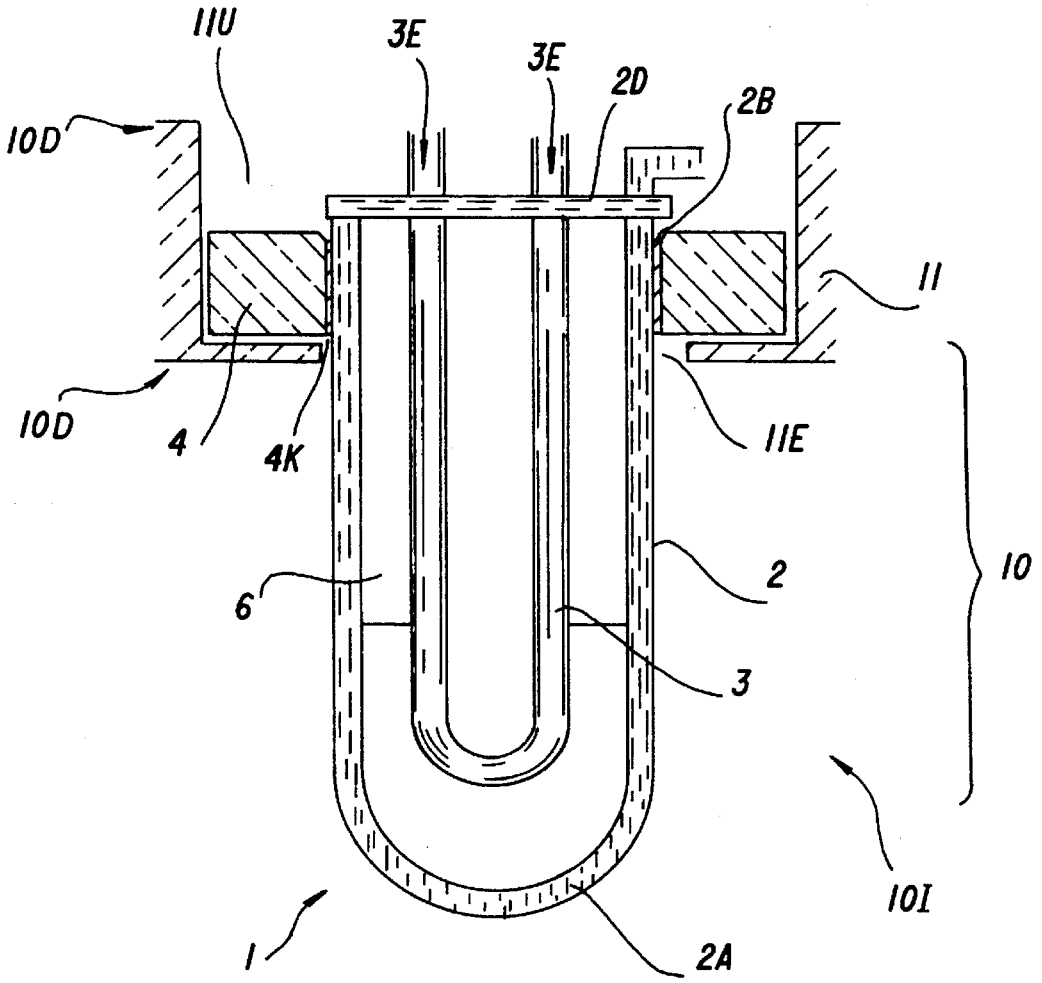
FIG. 1 is a fragmentary, diagrammatic, longitudinal-sectional view of a heating element with a ceramic flange.

Referring now to the figures of the drawing in detail and first, particularly, to FIG. 1 thereof, there is seen a heating element 1 which is surrounded by a protective tube 2 and within which a heating bar 3 is disposed. The protective tube 2 is constructed as a tube that is closed at one end and is produced from a ceramic material. A nitridic, oxidic or carbidic heavy-duty ceramic is preferably used for this purpose. A first end 2A of the protective tube 2, which is closed by means of a round dome, projects into a Deglor furnace 10. A second, open end 2B of the protective tube is provided on the outside with a flange 4. This flange 4 is formed by a ceramic ring. This ceramic ring is produced from a nitridic, oxidic or carbidic heavy-duty ceramic. For example, the ring 4 can be made from alpha-aluminum oxide. This ring is permanently fastened on the outside to the second end 2B of the protective tube 2 by means of a silicate-ceramic or phosphate-ceramic adhesive 4K or a cement. The Deglor furnace 10 has a ceiling 10D. The flange 4 is inserted into a U-shaped recess 11U of a ceiling brick 11 of the Deglor furnace 10. The U-shaped recess has an orifice 11E with a diameter that is selected in such a way that the protective tube 2 can be disposed in a position in which it projects virtually completely into the Deglor furnace 10. The flange 4 of the protective tube 2 is placed onto a lower limiting surface of the ceiling brick 11 at the U-shaped recess 11U and serves as a mounting for the heating element 1. Through the use of the flange 4, the orifice 11E is covered in an edge region and an inner region 10I of the Deglor furnace 10 is closed relative to the outside. In the embodiment shown herein, a disc-shaped cover 2D made of ceramic or metal is placed onto the protective tube 2. Ends 3E of the U-shaped heating bar 3 are inserted through the cover 2D and are guided outwards to non-illustrated electrical connections. At the same time, the two ends 3E of the heating bar 3 are constructed in such a way that they can be connected to the cover 2D. A permanent fastening of the heating bar 3 is brought about thereby. In the exemplary embodiment shown herein, the disc-shaped cover 2D is placed onto an upward-facing edge of the protective tube 2. An inner region of the protective tube 2 is thereby closed relative to the outside. In order to avoid heat losses, the U-shaped heating bar 3 is surrounded over approximately two-thirds of its length, from the cover 2D onwards, by a fiber insulation 6.

Figure 2:
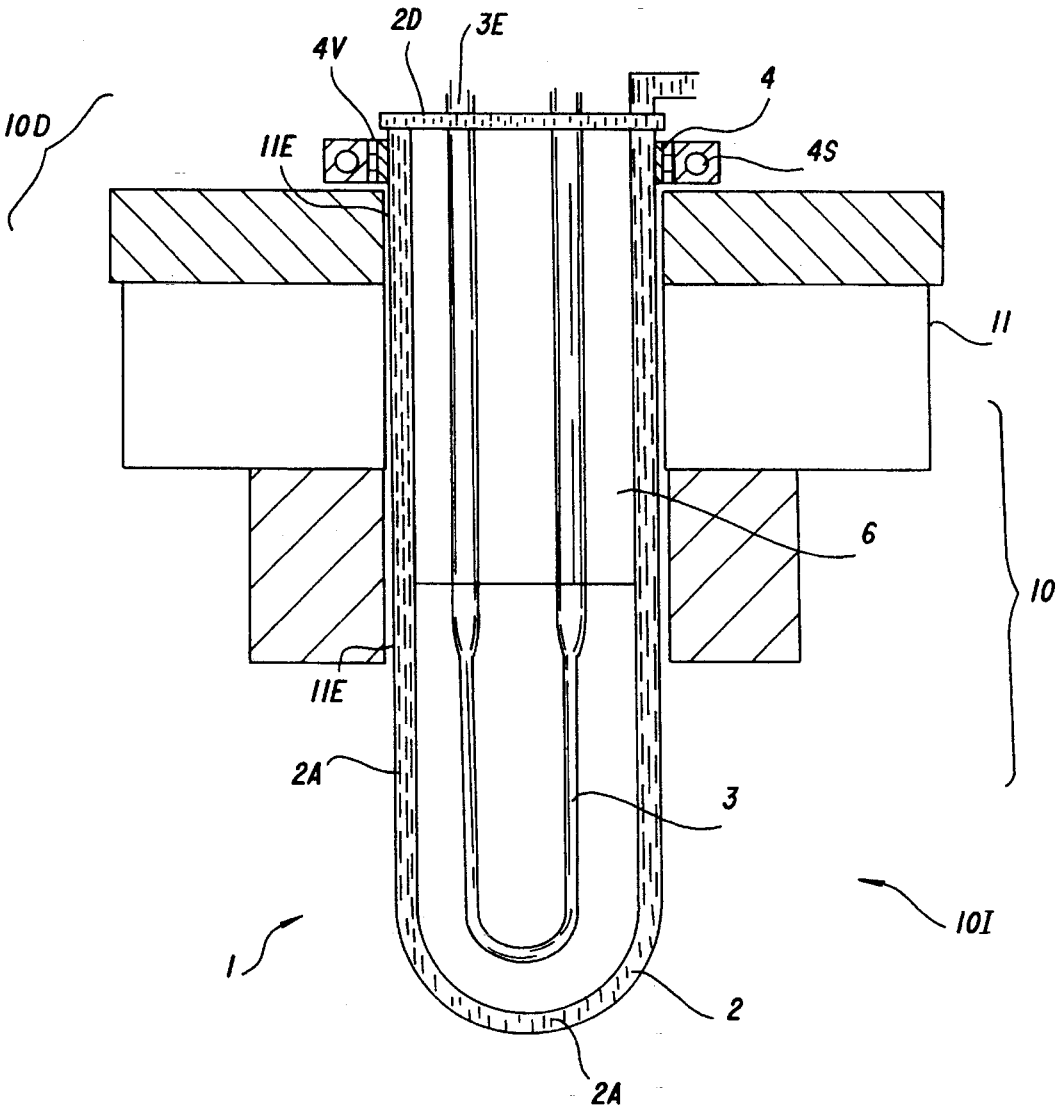
FIG. 2 is a view similar to FIG. 1 of a heating element with a metallic flange.

FIG. 2 shows a further embodiment of the heating element 1 according to the invention. This embodiment is preferably used when the protective tube 2 and the heating bar 3 disposed therein are constructed to be longer than in the embodiment shown in FIG. 1. The heating element 1 illustrated in FIG. 2 once again has the protective tube 2 within which the U-shaped heating bar 3 is disposed. Second ends 3E of the heating bar 3 are guided outwards through the disc-shaped cover 2D of the protective tube 2 and are connected to non-illustrated electrical connections. In this case too, the cover 2D is placed onto the edge of the protective tube 2. As in the embodiment illustrated in FIG. 1, in this case there is also the possibility of placing the cover 2D onto the flange 4. In the exemplary embodiment shown herein, the flange 4 disposed at the upper end of the protective tube 2 is formed by a metal clip which is of one-part or multi-part construction. The parts of the clip 4 are disposed around the upper outer end of the protective tube 2 and are permanently connected to one another by means of screws 4S. A ceramic fleece 4V which can additionally absorb compressive forces is disposed between the clip of the flange 4 and the protective tube 2. In order to fasten the heating element 1 to the ceiling 10D of the Deglor furnace 10, specific ceiling bricks 11 are provided with passages 11E formed therein. Diameters of these passages 11E are matched to the outside diameter of the protective tubes 2. It is thereby possible to insert the protective tubes 2 through the ceiling bricks 11 into the interior of the Deglor furnace 10. The protective tube 2 is held by the flange 4 which is fastened at its upper end and which, in this case, is formed by the metal clip. Since the second end 2E of the protective tube 2 is disposed outside the ceiling 10D of the Deglor furnace, a metallic flange can be used for mounting the heating element 1.

We claim:

1. A heating element for a furnace used for the vitrification of ash from refuse incineration plants, comprising:

a U-shaped heating bar defining two ends;

a ceramic protective tube surrounding said heating bar and having an outer surface, a closed end, an open end, and an edge;

a flange fastened to said outer surface of said protective tube at said open end, said flange being a ring made from a material selected from the group consisting of nitridic, oxidic and carbidic heavy-duty ceramic, said flange being fastened to said outer surface of said protective tube with an adhesive selected from the group consisting of silicate-ceramic adhesive and phosphate-ceramic adhesive, and being disposed in a U-shaped recess formed in a ceiling brick of the furnace;

said two ends of said heating bar being guided outwards for electrical connection through and being mounted on a cover disposed on said edge of said protective tube.

2. A heating element for a furnace used for the vitrification of ash from refuse incineration plants, comprising:

a U-shaped heating bar having two ends;

a ceramic protective tube surrounding said heating bar and having an outer surface, a closed end and an open end;

a ceramic flange formed of alpha-aluminum oxide, said flange being fastened to said outer surface of said protective tube at said open end with an adhesive selected from the group consisting of a silicate-ceramic adhesive and a phosphate-ceramic adhesive, and said flange being disposed in a U-shaped recess formed in a ceiling brick of the furnace; and a cover on said open end of said protective tube, said two ends of said heating bar being guided outwards for electrical connection through said cover and being mounted on said cover.

3. A heating element for a furnace used for the vitrification of ash from refuse incineration plants, the furnace having a ceiling, the heating element comprising:

a U-shaped heating bar having two ends;

a ceramic protective tube surrounding said heating bar, said protective tube having an outer surface, a closed end, an open end, an edge, and a cover placed on said edge;

a flange being fastened to said outer surface of said protective tube at said open end, said flange being a metal clip having at least one part; and a ceramic fleece disposed between said metal clip and said outer surface of said protective tube for fastening said metal clip to said protective tube;

said flange being disposed on an upper surface of the ceiling of the furnace, and said two ends of said heating bar being guided outwards for electrical connection through said cover and being mounted on said cover of said protective tube.

* * * * *

UNITED STATES PATENT AND TRADEMARK OFFICE

CERTIFICATE OF CORRECTION

PATENT NO. : 5,605,645

DATED : February 25, 1997

INVENTOR(S) : Anke Brandstaedter-SJringer et al.

It is certified that error appears in the above-indentified patent and that said Letters Patent is hereby corrected as shown below:

On the title page:

Item (75) should read as follows:

Anke Brandstadter-Springer, Heidelberg, Germany;
Ludwig Weiler, Heidelberg, Germany;
Hans Ammon, Wettingen, Switzerland;
Fritz Hegewaldt, Muenchen, Germany.

Item (30) should read as follows:

August 26, 1993 (DE) Germany ..... 43 28 718.2

Signed and Sealed this

Twenty-fourth Day of June, 1997

Bruce Lehman

*Attest:*

BRUCE LEHMAN

*Attesting Officer*

*Commissioner of Patents and Trademarks*